US005546771A

United States Patent [19]

Bonar

[11] Patent Number: 5,546,771

[45] Date of Patent: Aug. 20, 1996

[54] COMBINATION CLOTHES & DISH WASHER & DRYER

[76] Inventor: George D. Bonar, P.O. Box 8425, New York, N.Y. 10116

[21] Appl. No.: 314,294

[22] Filed: Sep. 30, 1994

[51] Int. Cl.[6] ..... D06F 39/00

[52] U.S. Cl. ..... 68/4; 134/95.2; 134/115 R; 211/181; 220/488

[58] Field of Search ..... 68/4; 134/95.2, 134/115 R, 201; 211/41, 181; 220/486, 487, 488, 532, 533

[56] References Cited

U.S. PATENT DOCUMENTS

| | | | |
|---|---|---|---|
| 1,579,569 | 4/1926 | Sherrick | 220/488 |
| 1,793,798 | 2/1931 | Harker | 68/4 X |
| 2,053,531 | 9/1936 | Parsons | 68/4 |
| 2,151,354 | 3/1939 | Osuch | 68/4 X |
| 2,251,600 | 8/1941 | Pollock | 211/181 X |
| 2,345,185 | 3/1944 | Edgar | 68/4 X |
| 2,549,677 | 4/1951 | Egerton | 68/4 |
| 2,563,046 | 8/1951 | Killin | 68/4 X |
| 2,603,097 | 7/1952 | Kelley et al. | 68/4 X |

*Primary Examiner*—Philip R. Coe
*Attorney, Agent, or Firm*—John B. Dickman, III

[57] ABSTRACT

A conversion kit for converting a clothes washer to a dishwasher by removing the agitator and installing a dish holding basket and a plurality of horizontal dividers with fingers to support dishware. A plurality of vertical dividers are inserted between the individual dishware pieces to prevent damage thereto. A hot air drier structure is mounted in the washer to dry the dishes when the clothes washer is used as a dishwasher.

7 Claims, 2 Drawing Sheets

COMBINATION CLOTHES & DISH WASHER & DRYER

BACKGROUND OF THE INVENTION

Dishwashers are well known in the prior patent art, said devices having a cabinet with a top and a bottom dish holding rack, and at least one rotating water spray. The dish holding racks are on rollers to move in and out of the cabinet for loading and unloading. The majority of modern kitchens are equipped with a dishwasher. As a rule, a dishwasher is used about once a day, otherwise, it just occupies space. In apartments, condominiums and housing, having limited space, a dishwasher may be a libility.

When faced with a choice between a dishwasher or a clothes washer, most people would choose a clothes washer. While a clothes washer is not used as often, its function outweighs the dishwasher's function. Therefore, if space or budget is tight, most often a clothes washer is the appliance of choice.

Unlike a dishwasher, a clothes washer has a stationary tub, a spin tub, and an agitator. During the wash cycle, the spin tub is immobile and only the agitator moves. While during the spin cycle when water is extracted, the agitator is immobile and the spin tub rotates. It has been realized by the inventor that a clothes washer could be adapted to wash dishes. The nature of the invention requires the removal of the clothes washer agitator and replacing it with an open basket means and series dividers.

The object of the invention is to provide a means to adapt a clothes washer to a dishwasher for use in those situations where either space or funds are limited.

SUMMARY OF THE INVENTION

The present inveniton relates to a conversion kit for converting a clothes washer to a dishwasher, and, in particular, a conversion kit for replacing the agitator assembly of a clothes washer with a dish holding basket.

The conversion kit is an open weave basket with a spindle mounting coupling for mounting on the motorized spindle which will agitate the basket. The bottom of the basket, where the coupling is affixed, is open meshed to allow fluids to enter and rinse articles in the basket. The open top basket has a cylindrical body with open mesh construction. The conversion kit also has a plurality of dividers for subdividing the basket into compartments for holding large plates, small plates, bowls and cups. Each divider has supports for holding the dishes in place during the washing and drying cycles.

DESCRIPTION OF THE INVENTION

Figure 1:
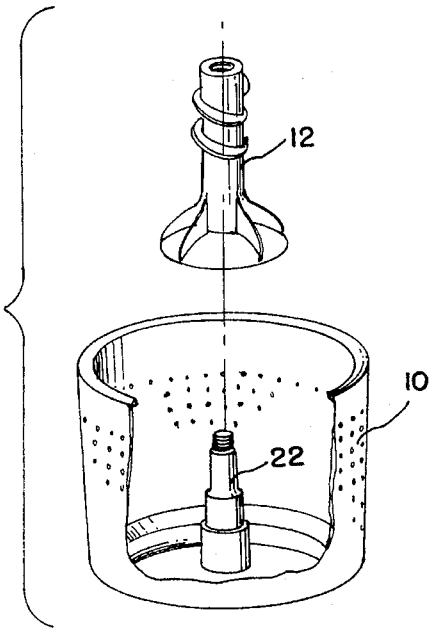
FIG. 1 is a perspective view of a clothes dryer drum and agitator.

Referring to the drawings FIGS. 1–8, there is shown in FIG. 1 a drum 10, and an agitator 12 of a clothes washer said clothes washer per se, not shown. The clothes washer includes a water pump and return, and a motor assembly for moving the agitator 12 and spin drum 10. In normal clothes washing procedure the agitator 12 is agitated while the drum 10 is stationary, and conversly, the agitator is stationary while the drum is spinning. Agitation of the clothes in a solution of water and clothes washing detergent removes any dirt from clothes. The clothes are rinsed and spun one or more times to remove the soapy water and partially dry the clothes. The mechanical action of agitation and spinning will be used in the present invention to convert a clothes washer to a dishwasher.

Figure 2:
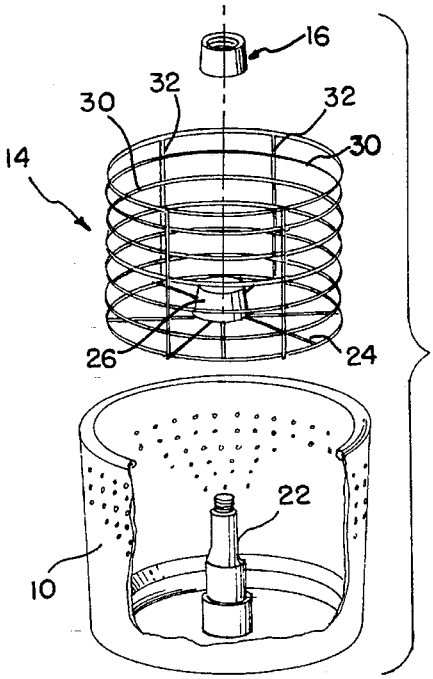
FIG. 2 is a perspective view of a clothes dryer drum and an open basket of the conversion kit of the invention.
Figure 3:
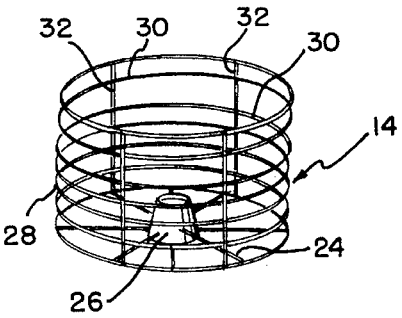
FIG. 3 is a perspective view of a dish basket of the invention.
Figure 4:
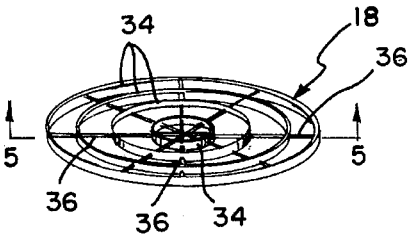
FIG. 4 is a perspective view of a dish divider of the invention.
Figure 5:
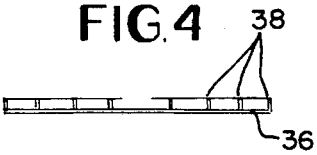
FIG. 5 is a cross-section view taken along the line 5—5 of FIG. 4.

FIGS. 2 through 7 show an open mesh dish holding basket 14 of the conversion kit which includes basket 14, a locking nut 16 and a plurality of dish dividers 18 and 20. In FIG. 2, dish holding basket 14 mounts on a spindle 22 which projects through the bottom of drum 10. Spindle 22 and drum 10 are connected to the gear and motor assembly found in most washing machines. The gear and motor assembly, not shown, includes a brake and clutch means for alternately shifting between the agitator 12 and drum 10 to move the agitator or spin the drum.

The agitator 12 of FIG. 1 is removed from drum 10 and the dish holding basket 14 of FIG. 2 is installed on spindle 22 and locked on the spindle by locking nut 16. Dish holding basket 14 is constructed of a plastic coated wire of the type associated with dish racks used in conventional dishwashers. The basket 14 has a mesh wire bottom 24 with a frusto-conical connector 26, which mounts on spindle 22, and an open mesh cylindrical wall 28. A plurality of coated wire hoops 30 are welded to uprights 32 in a spaced relationship. The top of basket 14 is open to receive dishes and dividers.

Figure 8:
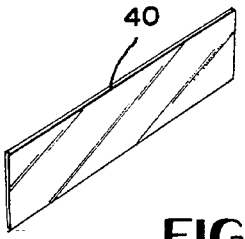
FIG. 8 is a perspective view of a divider of the invention.

The divider 18 is constructed of coated wires welded together. There are concentric hoops 34 of increasing size welded together with radiating ribs 36, FIG. 4. There are upstanding fingers 38 spaced around the concentric hoops 34 to support the dishware. Divider 18 is removed from the basket 14 in case larger cookware and the like is to be washed. With the divider in place, dishes can be loaded in the basket 14. If needed, solid plastic vertical dividers 40 can be placed in a radiating pattern on the divider 18 to protect the dishes from colliding during agitation and spinning. The solid plastic vertical divider is shown in FIG. 8.

Figure 6:
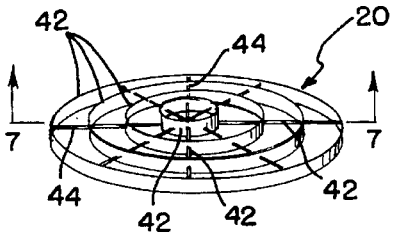
FIG. 6 is a perspective view of another dish divider of the invention.
Figure 7:
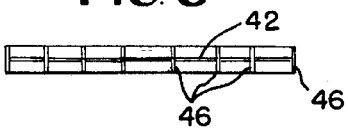
FIG. 7 is a cross-section view taken along the line 7—7 of FIG. 6.

FIGS. 6 and 7 show another type of divider 20 which has concentric hoops 42 and radiating ribs 44. A plurality of vertical fingers 46 extend above and below the divider to support the dishware supported above the divider and to engage and hold in place the dishware on the divider below.

The dividers are placed in the dish holding basket 14 with a divider 18 on the bottom and a plurality of dividers 20 above it. A number of vertical dividers 40 are inserted between the dividers separating dishware on the same divider against damage. A second divider 18 is installed with fingers 38 facing downwardly as a top closure.

In use with the agitator 12 removed and the dish holding basket 14, dividers 18 and 20 and vertical dividers 40 in place, the machine, which is now a dish washer, is loaded with dishes, silverware and pans. Dish washing detergent is added and water is pumped into the drum. The agitating motion of the dish holding basket 14 agitates the soapy water to clean the dishes, etc. When the wash cycle ends, the agitation of the dish holding basket 14 stops, the drum 10 is spun to remove the dish water. Clean water is cycled through the drum to rinse the wash water from the dishes, and then the drum is again spun to dry the dishware.

Figure 9:
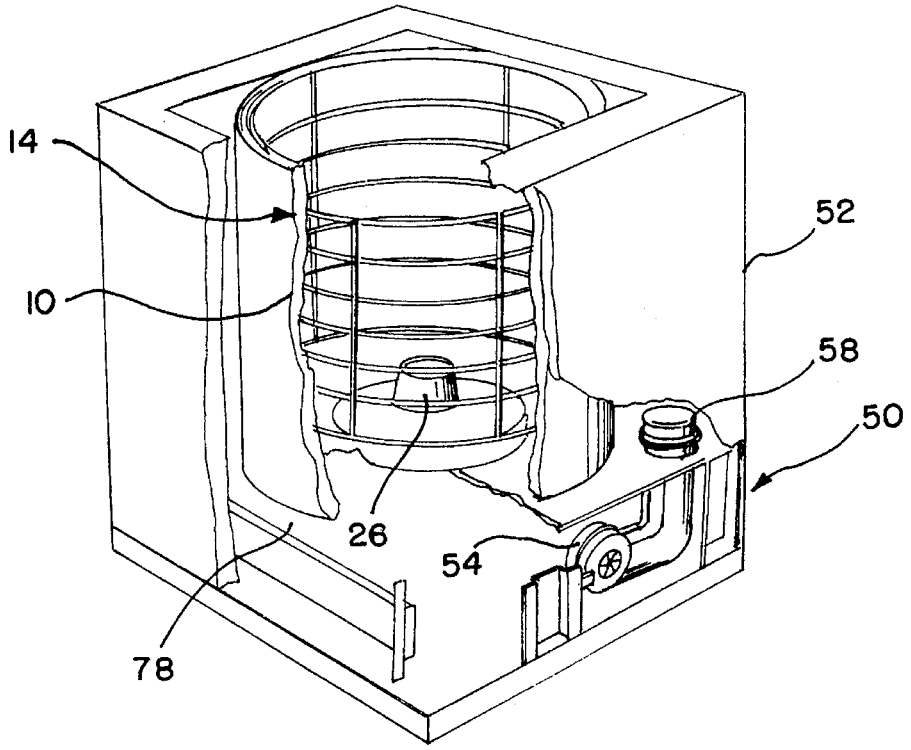
FIG. 9 is a perspective view of a clothes washer with a conversion kit of the invention showing a section of a cabinet.
Figure 10:
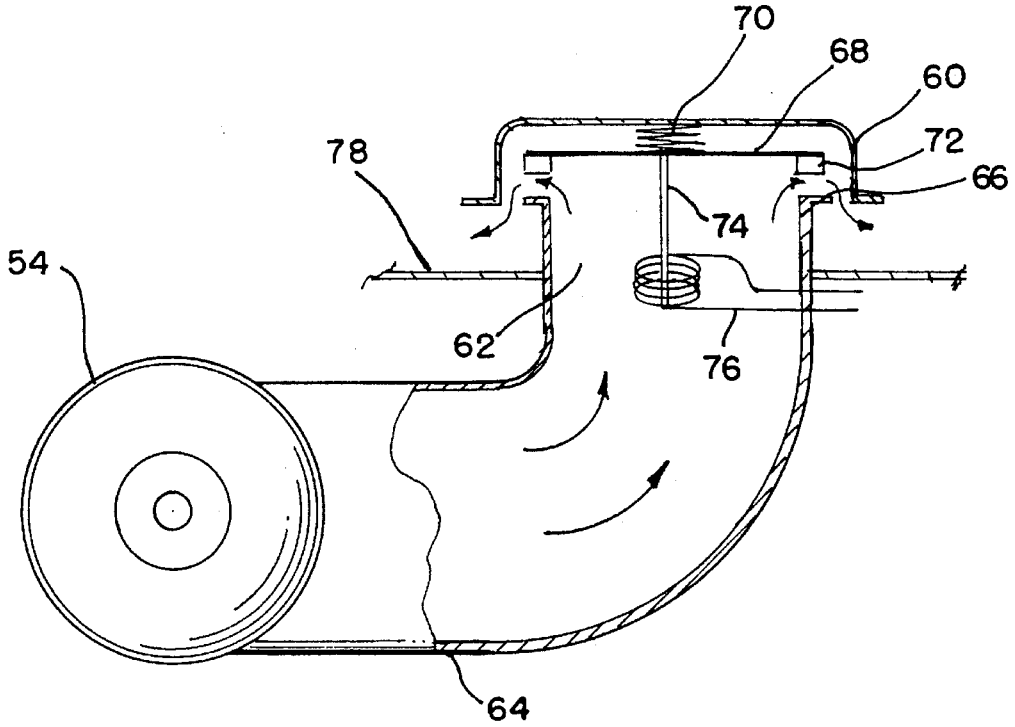
FIG. 10 is a side cross-section view of a drier of the invention.

In another embodiment of the invention, FIG. 9 shows a frame structure 50 and cabinet 52. The clothes washer drum 10 is mounted on spindle 22 connected to the gear and motor assembly found in most clothes washing machines. A dish holding basket 14 is connected to spindle 22 by frusto conical connector 26. An air drier blower 54 circulates hot air through the inside of the cabinet 52, passing through holes 56 in the clothes washer drum 10 and dish holding basket 14. An air circulating valve 58 controls the flow of air into the cabinet.

Air circulating valve 58 has an air flow cap 60 covering an opening 62 in an air conduit 64 which extends through floor 78 and connects to air drier blower 54. The open end of the air conduit 64 has a flange 66 which mates with a movable valve 68. A spring 70 presses the movable valve 68 against flange 66 to form a water tight seal. A water proof gasket 72 is firmly pressed against flange 66 by spring 70. An iron stem 74 is mounted on movable valve 68 to set up an electromagnetic switching means to unseat the movable valve 72. Current is passed through wire 76 when the air drier blower 54 is cycled on. The operation of the air drier system is such that when the wash water is drained from the machine the air drier is automatically turned on.

The air drier and valve structure represent one type of drier system which can be used with the invention. Other air driers may be used as long as they are protected against electrical shorts, therefore all electrical elements should be sealed against water and moisture.

While only two embodiments of the invention have been shown, it is believed that one skilled in the art may realize other embodiments; therefore, one should consider the drawings, description and claims for a complete understanding of the invention.

I claim:

1. A conversion kit for converting a clothes washer to a dishwasher, comprising;

an open mesh basket having an open mesh bottom with a connector for mounting said open mesh basket on a washing machine agitator spindle, an open top and an open mesh cylindrical wall;

a plurality of divider means for inserting in said open mesh basket, each of said plurality of said divider means having an open mesh disc shape with a plurality of vertical finger means for supporting dishware, where one of said divider means is inserted in the open mesh basket to receive dishware and another of said divider means is inserted to provide said plurality of divider means separated by dishware; and, a plurality of vertical dividers for separating dishware, where said vertical dividers radiate from said mesh dish shape divider means for mounting said open mesh basket on a washing machine agitator spindle.

2. A conversion kit as in claim 1 wherein said plurality of divider means include first and second divider means, said first divider means having upstanding vertical finger means and said second divider means having upstanding vertical finger means and downwardly vertical finger means where said upstanding vertical finger supports dishware and said downwardly vertical finger means hold dishware in place.

3. A conversion kit as in claim 2 wherein said connector in said open mesh basket is locked on a clothes washer spindle by a lock nut.

4. A conversion kit as in claim 3 wherein said open mesh basket and said plurality of divider means are constructed of plastic coated wires.

5. A conversion kit as in claim 4 wherein the clothes washer includes a floor and a drier means, said drier means being connected to said floor, whereby said drier means circulates air through said circular mesh basket to dry dishes.

6. A conversion kit as in claim 5 wherein said drier means includes an opening into the clothes washer and a water tight valve means connected to said opening.

7. A conversion kit as in claim 6 wherein said drier means cycles to provide hot air and open said water tight valve means when water has been drained from said clothes washer.

* * * * *